US005921807A

United States Patent [19]

Okabe

[11] Patent Number: 5,921,807

[45] Date of Patent: Jul. 13, 1999

[54] CRIMPING CONNECTOR

[75] Inventor: Toshiaki Okabe, Shizuoka, Japan

[73] Assignee: Yazaki Corporation, Tokyo, Japan

[21] Appl. No.: 08/917,114

[22] Filed: Aug. 25, 1997

[30] Foreign Application Priority Data

Aug. 30, 1996 [JP] Japan ..... 8-230606

[51] Int. Cl.[6] ..... H01R 13/58

[52] U.S. Cl. ..... 439/467; 439/596

[58] Field of Search ..... 439/467, 465, 439/701, 596, 598

[56] References Cited

U.S. PATENT DOCUMENTS 4,629,279 12/1986 Nishikawa ..... 439/596

5,122,077 6/1992 Maejima et al. ..... 439/701

FOREIGN PATENT DOCUMENTS 59-184476 12/1984 Japan .

*Primary Examiner*—Paula Bradley

*Assistant Examiner*—Tho D. Ta

*Attorney, Agent, or Firm*—Sughrue, Mion, Zinn, Macpeak & Seas, PLLC

[57] ABSTRACT

There is provided a construction in which the efficiency of an assembling operation is enhanced, and also the efficiency of arrangement of a terminal assembly in a mating connector is enhanced. Each of two housings 10 and 11 includes an upwardly-open wire connecting portion 2 and a terminal connecting portion 3 of a closed cross-sectional shape communicating with the wire connecting portion 2. The two housings 10 and 11 are disposed respectively on opposite sides of a cover member 18, with upper surfaces of the wire connecting portions 2 directed upwardly, and are integrally connected to the cover member 18 through hinges 20 and 4 so that the wire connecting portions 2 of the two housings, as well as the terminal connecting portions 3 thereof, can be stacked together relative to the cover member 18 vertically in the same position and the same direction. When the two housings 10 and 11 are stacked together, crimping terminals 30, which are mounted on the two housings 10 and 11, and are press-connected respectively to sheathed wires 40, are arranged vertically in the same position and the same normal direction.

10 Claims, 11 Drawing Sheets

CRIMPING CONNECTOR

BACKGROUND OF THE INVENTION

This invention relates to a crimping connector, and more particularly to a crimping connector having a terminal receiving portion for receiving crimping terminals connected respectively to many wires of an electronic equipment, a wire harness in an automobile or the like.

One conventional crimping connector of the type described is disclosed in Japanese Utility Model Unexamined Publication No. 59-184476. As shown in FIGS. 1(*a*)–1(*c*), this crimping connector 100 comprises two housings 101 and 102 of an identical configuration integrally connected together through a thin hinge 105 at their adjacent sides in right-left symmetrical relation to each other, and each of the housings 101 and 102 including an upwardly-open wire connecting portion 103 and a terminal connecting portion 104 of a closed cross-sectional shape communicating with the wire connecting portion 103 (see FIGS. 1(*a*) and 1(*b*)). The wire connecting portion 103 has a plurality of juxtaposed receiving portions 107 separated from one another by a plurality of partition walls 106, and crimping terminals 108 are mounted in the receiving portions 107, respectively. The crimping terminal 108 is fitted in the receiving portion 107 in such a manner that part of this terminal 108 is inserted in the terminal connecting portion 104. As shown in FIG. 2, a plurality of terminal insertion ports 110 for respectively receiving male terminals (not shown) in a mating housing 400 are formed in one side surface 109 of the terminal connecting portion 104, and correspond respectively to the receiving portions 107. Inserted ends of the crimping terminals 108, inserted in the terminal connecting portion 104, communicate with the terminal insertion ports 110, respectively.

Sheathed wires 200 are supplied to be disposed respectively above the crimping terminals 108, and are pressed downward by a crimping jig 300, and are press-fitted respectively into slots 111 formed respectively in the crimping terminals 108 (see FIG. 1(*b*)). As a result of this press-fitting operation, a sheath of each sheathed wire 200 is cut by opposite side edges of the slot 111, so that a conductor 201 of the sheathed wire 200 is contacted with the crimping terminal 108, and hence is press-connected thereto (see FIG. 1(*c*)).

After each sheathed wire 200 is thus connected to the associated crimping terminal 108, one of the housings 102 (or 101) is turned about the hinge 105 in a direction of an arrow, so that the open sides of the receiving portions 107 in the housing 101 are opposed and joined to the open sides of the receiving portions 107 in the housing 102 (see FIG. 1(*c*)), thereby obtaining the crimping connector 100 of a two-stage construction as shown in FIG. 2.

However, in the conventional crimping connector 100, when the two housings 101 and 102 are joined together, the crimping terminals 108 in the lower-stage housing 101 and the crimping terminals 108 in the upper-stage housing 102 are vertically inverted with respect to each other, and therefore the male terminals in the mating connector 400 need to be arranged in accordance with the arrangement of the crimping terminals 108, which has invited a problem that the efficiency of arrangement of a terminal assembly in the mating connector 400 is lowered.

More specifically, if each of the male terminals 401 in the mating connector 400 includes a contact terminal 402 having a joint portion 403 as shown in FIGS. 3(*a*) and 1(*b*), and the male terminals 401 for the upper and lower stages are arranged in the same normal direction in the mating connector 400, there inevitably occurs a condition in which the joint portions 403 contact resilient contact portions 112 of the crimping terminals 108, provided in the lower-stage housing 101 or the upper-stage housing 102 (see FIG. 4), when the mating connector 400 is fitted on the crimping connector 100. In this case, an electrically-insulating substance is liable to be produced at each joint portion 403 held in contact with the resilient contact portion 112, so that the electrically-contacted condition is not stable. Therefore, it is necessary to mount the terminal assembly of the mating connector 400 in such a manner that the terminal assembly will not be in the above contacted condition. As a result, there has been encountered a problem that the assembling operation is complicated, so that the efficiency of the operation is lowered.

SUMMARY OF THE INVENTION

The present invention has been made in order to overcome the above problems, and an object of the invention is to provide a crimping connector in which the efficiency of an assembling operation is enhanced, and also the efficiency of arrangement of a terminal assembly in a mating connector is enhanced.

The above object of the invention has been achieved by a crimping connector according to a first aspect of the present invention comprising:

- two housings each including an upwardly-open wire connecting portion and a terminal connecting portion of a closed cross-sectional shape communicating with the wire connecting portion;
- a cover member having opposite sides on which the two housings are disposed respectively while upper surfaces of the wire connecting portions both of two housings are directed upwardly; and
- hinge members for integrally connecting each of the two housings to the cover member in such a manner that the wire connecting portions of the two housings, as well as the terminal connecting portions of the two housings, can be stacked together relative to the cover member vertically in the same position and the same direction.

In the first aspect of the present invention, when the two housings are stacked together, crimping terminals, mounted on the upper-stage housing, and crimping terminals, mounted on the lower-stage housing, are arranged vertically in the same position and the same direction, and also the terminals in the mating connector can be arranged in the normal direction. Since the two housings and the cover member are integrally connected together through the hinges, any operation for registering each housing with the cover member or for registering the housings with each other is not necessary.

In the above-mentioned crimping connector, as the second aspect of the present invention, preferably, one of the two housings is connected to the cover member through the first hinge so that the one housing can be turned to be superposed on the cover member, with the upper surface of the wire connecting portion thereof opposed to an upper surface of the cover member, and the other housing is connected to the cover member through the second hinge so that the other housing can be turned to underlie the cover member, with a lower surface of the wire connecting portion thereof opposed to a lower surface of the cover member, and a sub-cover member for covering the upper surface of the wire connecting portion of the other housing is connected to the wire connecting portion of the other housing through a third hinge.

Therefore, in the second aspect of the present invention, when the one housing is turned to be superposed on the cover member, the upper surface of the wire connecting portion of the one housing is covered with the cover member, and when the other housing is turned to underline the cover member, the upper surface of the wire connecting portion of the other housing is covered not with the cover member but with the sub-cover member. The two housings, the cover member and the sub-cover member are connected together through the hinges, any registration operation for the housings, the cover member and the sub-cover member is not necessary at the time of the stacking operation, so that the stacking operation can be simplified.

In the above-mentioned crimping connector, as a third aspect of the present invention, preferably, one of the two housings is connected to the cover member through the first hinge so that the one housing can be turned to be superposed on the cover member, with the upper surface of the wire connecting portion thereof opposed to an upper surface of the cover member, and the other housing is connected to the cover member through the second hinge so that the other housing can be turned to be superposed on the one housing in the stacked condition, with the upper surface of the wire connecting portion thereof opposed to the one housing.

Therefore, in the third aspect of the present invention, when the one housing is turned to be superposed on the cover member, the upper surface of the wire connecting portion of the one housing is covered with the cover member, and when the other housing is turned to be superposed on the one housing, the upper surface of the wire connecting portion of the other housing is covered with the lower surface of the one housing. Therefore, any sub-cover member for covering the wire connecting portion of the other housing is not necessary.

In the above-mentioned crimping connector, as a fourth aspect of the present invention, preferably, terminal insertion portions for said two housings are formed integrally with said cover member, and terminals of a mating connector can pass through said terminal insertion portions.

In the fourth aspect of the present invention, thus, the terminal insertion portions are not formed respectively on the two housings, but are formed integrally on the cover member, and therefore the fitting surfaces for the mating connector can be highly precisely formed without being influenced by warpage of the housings and a play in the lock portions.

In the above-mentioned crimping connector, as a fifth aspect of the present invention, preferably, a recess is formed in a bottom surface of the wire connecting portion of each of the two housings disposed adjacent to one side thereof remote from the terminal connecting portion, and extends along this side, and projections are formed respectively on the cover member and the sub-cover member, and the projections are opposed respectively to the recesses in the stacked condition of the one housing and the sub-cover member.

In the fifth aspect of the present invention, when the one housing is turned to be superposed on the cover member, sheathed wires, connected to the wire connecting portion of this housing, are curved into a generally C-shape, and are held between the projection on the cover member and the recess in the housing. Also, when the sub-cover member is turned to be held against the other housing, sheathed wires, connected to the wire connecting portion of the other housing, are curved into a generally C-shape, and are held between the projection on the sub-cover member and the recess in the other housing. Therefore, the resistance against a pulling force, acting on the sheathed wires connected to the two housings, is increased, thereby enhancing the wire holding force.

In the above-mentioned crimping connector, as a sixth aspect of the present invention, preferably, a recess is formed in a bottom surface of the wire connecting portion of each of the two housings disposed adjacent to one side thereof remote from the terminal connecting portion, and extends along this side, and projections are formed respectively on the cover member and the one housing, and the projections are opposed respectively to the recesses in the stacked condition of the two housings.

In the sixth aspect of the present invention, when the one housing is turned to be superposed on the cover member, sheathed wires, connected to this housing, are curved into a generally C-shape, and are held between a projection on the cover member and a recess in the housing. Also, when the other housing is turned to be superposed on the one housing, sheathed wires, connected to the other housing, are curved into a generally C-shape, and are held between the projection on the one housing and the recess in the other housing. Therefore, the resistance against a pulling force, acting on the sheathed wires connected to the two housings, is increased, thereby enhancing the wire holding force.

BRIEF DESCRIPTION OF THE DRAWINGS

FIG. 1(*b*) being a side view showing a process of press-connecting sheathed wires respectively to crimping terminals, and FIG. 1(*c*) being a side view of the conventional crimping connector, showing a condition in which housings are joined together in a stacked manner;

FIG. 3(*b*) is a cross-sectional view taken along the line IIIb—IIIb of FIG. 3(*a*);

FIG. 10(*b*) is a cross-sectional view taken along the line Xb—Xb of FIG. 10(*a*);

FIG. 13(*b*) is a cross-sectional view taken along the line XIIIb—XIIIb of FIG. 13(*a*).

DESCRIPTION OF THE PREFERRED EMBODIMENTS

A preferred embodiment of the present invention will now be described with reference to the drawings.

Figure 1:
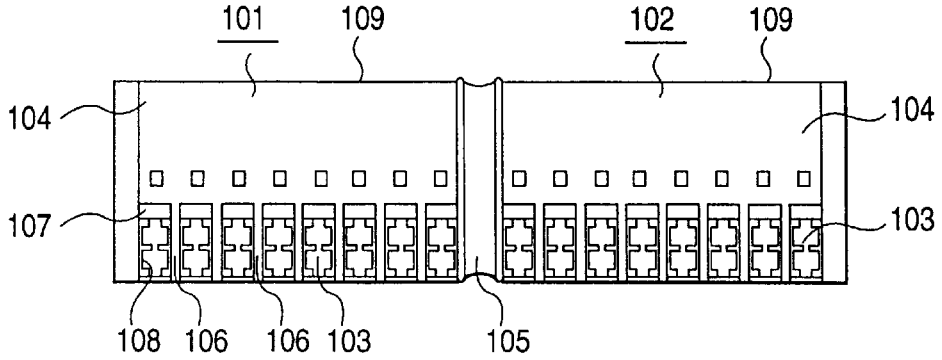
FIG. 1 (a) PRIOR ART
FIGS. 1(*a*)–1(*c*) shows a process of assembling a conventional crimping connector, FIG. 1(*a*) being a plan view showing a housing on which crimping terminals are mounted.
Figure 1:
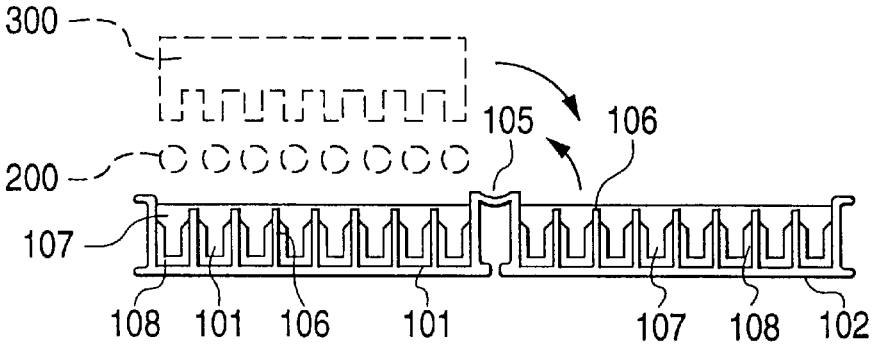
FIG. 1 (b) PRIOR ART
Figure 1:
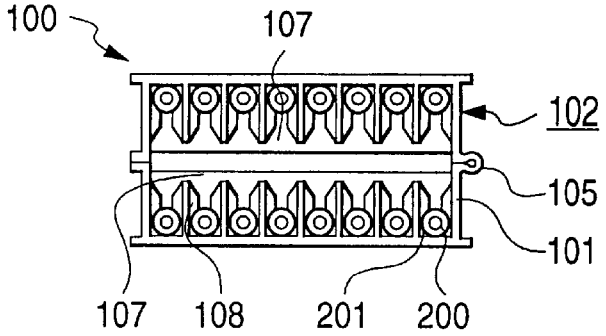
FIG. 1 (c) PRIOR ART
Figure 2:
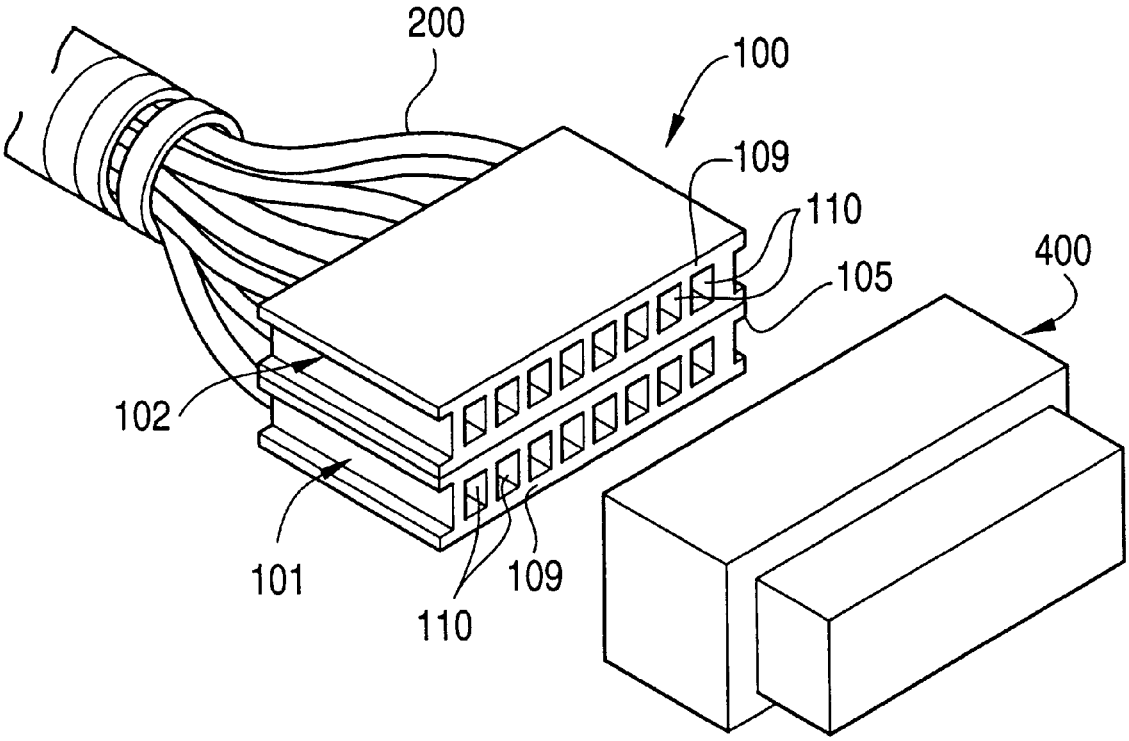
FIG. 2 PRIOR ART
FIG. 2 is a perspective view showing the conventional crimping connector and a mating connector to be fitted on this crimping connector.
Figure 3:
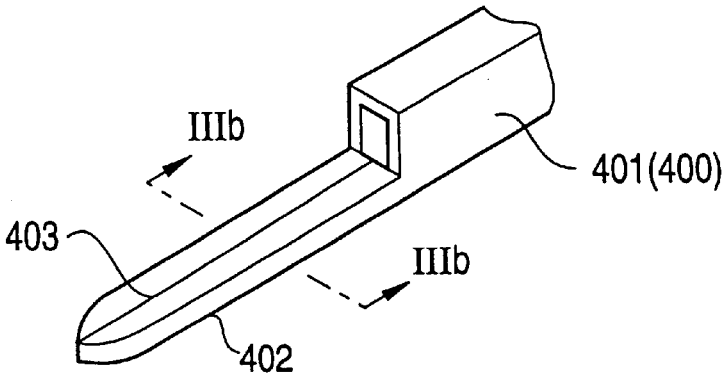
FIG. 3 (a) PRIOR ART
FIG. 3(*a*) is a perspective view showing an important portion of a male terminal of the mating connector.
Figure 3:
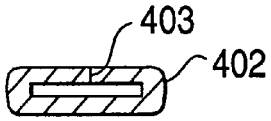
FIG. 3 (b) PRIOR ART
Figure 4:
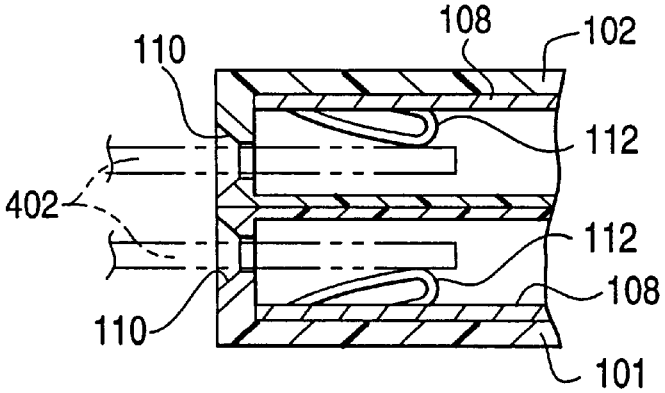
FIG. 4 PRIOR ART
FIG. 4 is a fragmentary cross-sectional view showing a condition in which the male terminals of the mating connector are inserted into the conventional crimping connector.
Figure 5:
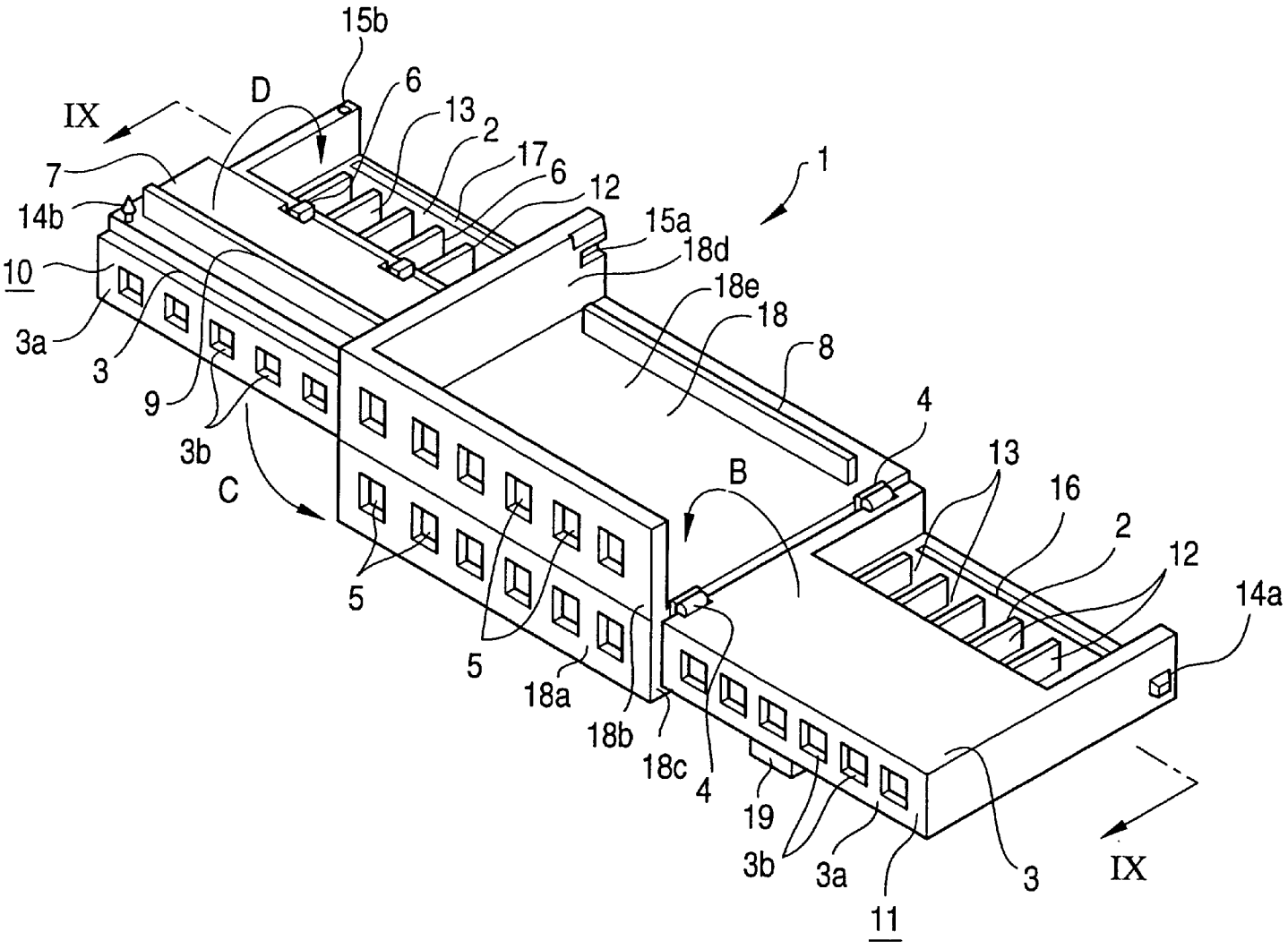
FIG. 5 is a perspective view of a housing used in one preferred embodiment of a crimping connector of the invention.

FIG. 5 shows a housing 1 used in one preferred embodiment of a crimping connector of the invention. This housing 1 comprises a lower-stage housing 10 and an upper-stage housing 11 each including an upwardly-open wire connecting portion 2 and a terminal connecting portion 3 of a closed cross-sectional shape communicating with the wire connecting portion 2. The housings 10 and 11 are disposed respectively on opposite sides of a cover member 18, with upper surfaces of the wire connecting portions 2 directed upwardly, and are integrally connected to the cover member 18 through hinges 20 and 4 (see FIG. 9(*a*)) so that the wire connecting portions 2 of the two housings 10 and 11, as well as the terminal connecting portions 3 thereof, can be stacked together relative to the cover member 18 vertically in the same position and the same direction.

The wire connecting portion 2 of each of the upper-stage and lower-stage housings 10 and 11 has a plurality of terminal receiving portions 13 separated from one another by a plurality of parallel partition walls 12. A recess 17, 16 is formed in a bottom surface of each wire connecting portion 2 disposed adjacent to one side or end thereof remote from the terminal connecting portion 3, and extends along this side. A plurality of openings 3*b*, corresponding respectively to the terminal receiving portions 13, are formed in an end surface 3*a* of the terminal connecting portion 3 of each of the lower-stage and upper-stage housings 10 and 11 remote from the wire connecting portion 2. A sub-cover member 7 for covering the upper surface of the wire connecting portion 2 is integrally connected to the terminal connecting portion 3 of the lower-stage housing 10 through third hinges 6, and is superposed on the terminal connecting portion 3, with its lower side directed upwardly. A retaining portion 19 for retaining the connector on other member is formed integrally on the lower surface of the upper-stage housing 11. A projection 9 is formed integrally on the lower surface of the sub-cover member 7, and this projection 9, when covering the wire connecting portion 2, is opposed to the recess 17.

The cover member 18 includes a flat plate portion 18*e* of a rectangular shape, an upper side wall 18*d* and a lower side wall 18*c* extending upwardly and downwardly respectively from opposite side edges of the flat plate portion 18*e*, and an upper terminal insertion 18*b* and a lower terminal insertion portion 18*a* extending upwardly and downwardly respectively from a front edge of the flat plate portion 18*e*. The upper terminal insertion portion 18*b* cooperates with the upper side wall 18*d* to assume an L-shape, and the lower terminal insertion portion 18*a* cooperates with the lower side wall 18*c* to assume an L-shape.

Thus, the upper and lower terminal insertion portions 18*b* and 18*a* are formed integrally with the front edge of the support plate 18*e*, and extend upwardly and downwardly respectively from this front edge, and a plurality of terminal insertion ports 5 for respectively receiving male terminals in a mating connector (not shown) are formed in each of the terminal insertion portions 18*b* and 18*a*. A projection 8 is formed on the upper surface of the flat plate portion 18*e* disposed adjacent to a rear edge thereof, and extends along this rear edge. When the upper-stage and lower-stage housings 11 and 10 are turned to be stacked together relative to the cover member 18, the terminal insertion ports 5 in the terminal insertion portion 18*b* communicate respectively with the openings 3*b* in the upper-stage housing 11 whereas the terminal insertion ports 5 in the terminal insertion portion 18*a* communicate respectively with the openings 3*b* in the lower-stage housing 10. When the upper-stage housing 11 is turned to be superposed on the cover member 18, the projection 8 is opposed to the recess 16 in the upper housing 11.

The upper-stage and lower-stage housings 11 and 10 and the cover member 18 are connected together in the following manner. The cover member 18 is disposed in a central position, and the upper-stage and lower-stage housings 11 and 10 are disposed respectively on the opposite sides of the cover member 18. At this time, the upper-stage and lower-stage housings 11 and 10 are disposed adjacent respectively to the lower side wall 18*c* and the upper side wall 18*d* of the cover member 18 in such a manner that the upper surface of each of the wire connecting portions 2 is directed upwardly and that the end surfaces 3*a* of the two housings 11 and 10 each having the openings 3*b* are juxtaposed respectively to the terminal insertion portions 18*a* and 18*b* of the cover member 18. The upper-stage housing 11 is connected by the first hinges 4 to the cover member 18 at their adjacent sides so that the upper-stage housing 11 can be turned (in a direction of arrow B in FIG. 5) so as to bring the upper surface of the wire connecting portion 2 into opposed relation to the upper surface of the flat plate portion 18*e* of the cover member 18. The lower-stage housing 10 is connected by the second hinges 20 to the cover member 18 at their adjacent sides so that the lower-stage housing 10 can be turned (in a direction of arrow C in FIG. 5) so as to bring the lower side of the wire connecting portion 2 into opposed relation to the lower surface of the flat plate portion 18*e* of the cover member 18 (see FIG. 9(*a*)).

The housing 1, comprising the upper-stage and lower-stage housings 11 and 10, the cover member 18, the sub-cover member 7 and the above-mentioned connecting structures, is formed into an integral construction, using an electrically-insulating resin.

In FIG. 5, a retaining projection 14*a* is formed on that side surface of the upper-stage housing 11 remote from the cover member 18, and in the stacked condition of the upper-stage housing 11, the retaining projection 14*a* is engaged in a retaining recess 15*a*, formed in the upper side wall 18*d* of the cover member 18, thereby maintaining the stacked condition of the upper-stage housing. A retaining projection 14*b* is formed on the lower surface of the sub-cover member 17, and when the sub-cover member 7 is turned (in a direction of arrow D in FIG. 5) into a stacked condition, the retaining projection 14*b* is engaged in a retaining recess 15*b*, formed in the upper surface of the side wall of the lower-stage housing 10, thereby maintaining the stacked condition of the sub-cover member 7. As described above for the upper-stage housing 11, a retaining projection (not shown) is formed on that side surface of the lower-stage housing 10 remote from cover member 18, and in the stacked condition of the lower-stage housing, this retaining projection is engaged in a retaining recess (not shown), formed in the inner surface of the lower side wall 18*c* of the cover member 18, thereby maintaining the stacked condition of the lower-stage housing.

Figure 6:
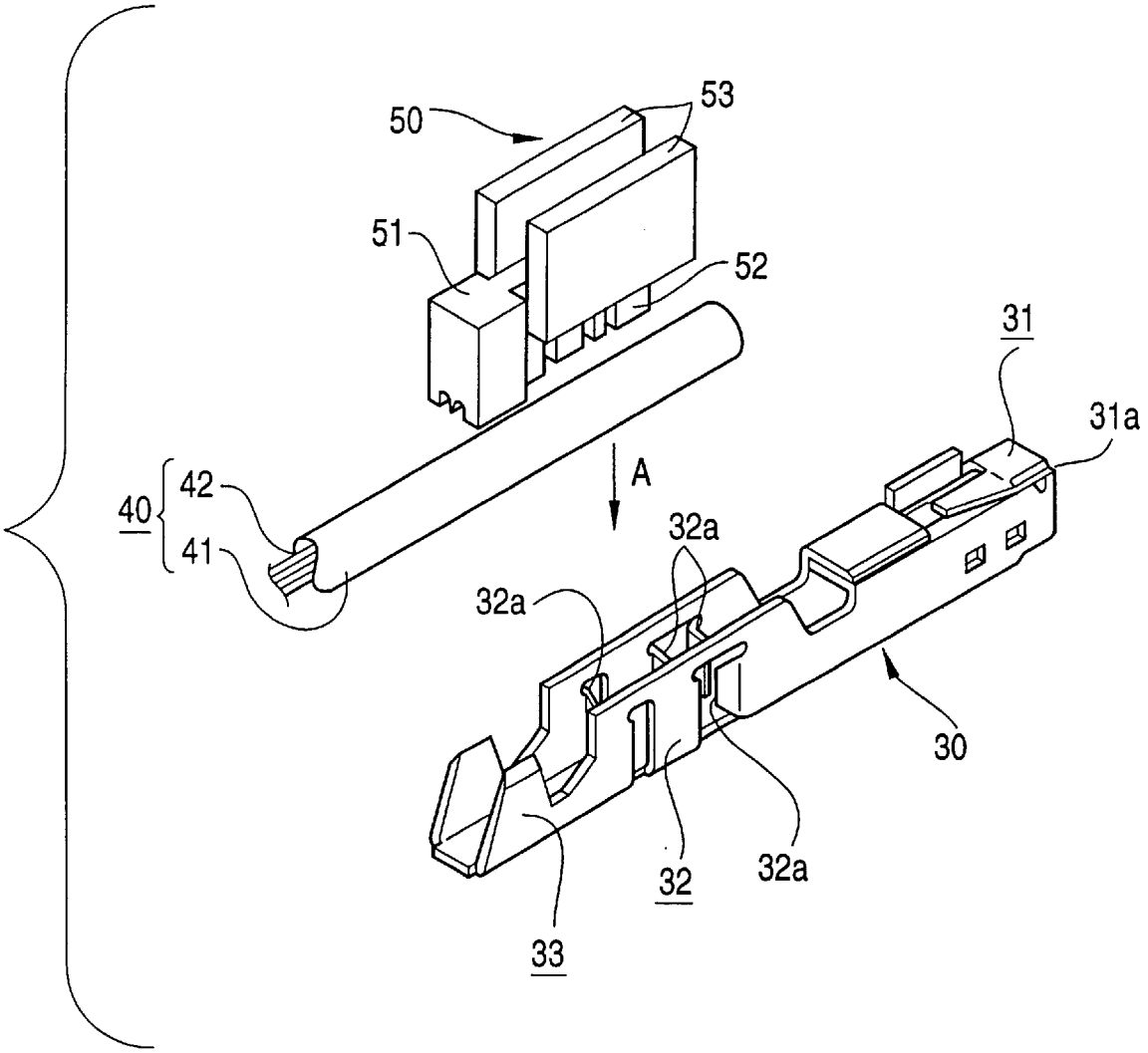
FIG. 6 is a perspective view showing a crimping terminal to be mounted on the housing of FIG. 5, as well as a crimping jig used for this mounting operation.

FIG. 6 shows the crimping terminal 30 used in this embodiment. This crimping terminal 30 includes a contact 31 for receiving the male terminal (not shown) to make electrical contact therewith, a crimping portion 32, and a wire holding portion 33 disposed adjacent to one end of the crimping portion 32 remote from the contact 31. When the sheathed wire 40 is pressed into the crimping portion 32 in a direction of arrow A (FIG. 6) by a crimping jig 50, crimping blades 32*a* cut a sheath 41 to make electrical contact with a conductor 42. The wire holding portion 33 is bent inwardly to fixedly hold the sheathed wire 40 around the sheath 41.

The crimping terminals 30 are mounted respectively in the terminal receiving portions 13 of the lower-stage and upper-stage housings 10 and 11 in such a manner that the contact 31 of each crimping terminal 30 is inserted into the terminal connecting portion 3 while the crimping portion 32 and the wire holding portion 33 are fitted in the associated terminal receiving portion 13.

In this mounted condition, openings 31*a*, formed respectively in the contacts 31 of the crimping terminals 30 mounted on the lower-stage and upper-stage housings 10 and 11, are disposed in registry respectively with the openings 3*b* in the terminal connecting portions 3, and when the lower-stage and upper-stage housings 10 and 11 are turned to be stacked together relative to the cover member 18, the openings 31*a*, formed respectively in the contacts 31 of the crimping terminals 30, communicate respectively with the terminal insertion ports 5, formed in the upper and lower terminal insertion portions 18*a* and 18*b*, through the openings 3*b* in the lower-stage and upper-stage housings 10 and 11. In this construction, each male terminal (not shown) of the mating connector is inserted into the associated terminal insertion port 5 in the terminal insertion portion 18*a*, 18*b*, and is inserted into the associated contact 31 through the opening 3*b* in the housing 10, 11, thereby making an electrical connection between the male terminal and the crimping terminal 30.

The sheathed wires 40 are attached respectively to the crimping terminals 30 mounted on the lower-stage and upper-stage housings 10 and 11. This attaching operation will be described with reference to FIGS. 6 to 8.

The crimping jig 50, used for this attaching operation, includes a press piece portion 52 for downward movement in registry with the crimping blades 32*a* so as to press the sheathed wire 40 into the crimping terminal 30, a cramper 51 which is formed integrally with the press piece portion 52, and is downwardly movable in registry with the wire holding portion 33 of the crimping terminal 30 so as to inwardly bend the wire holding portion 33, and guide plates 53 which are provided respectively on opposite sides of the press piece portion 52, and are vertically movable so as to prevent the crimping blades 32*a* from being excessively opened during the pressing operation.

Figure 7:
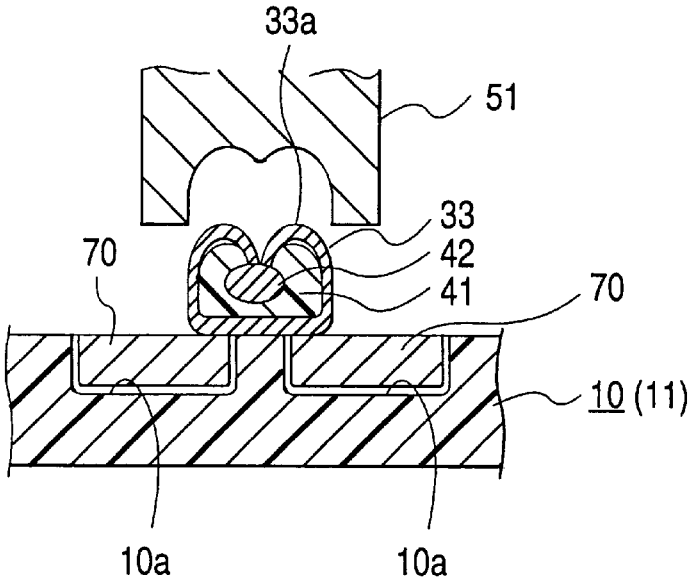
FIG. 7 is a cross-sectional view showing the step of press-connecting a sheathed wire to a wire holding portion of the crimping terminal of FIG. 6.
Figure 8:
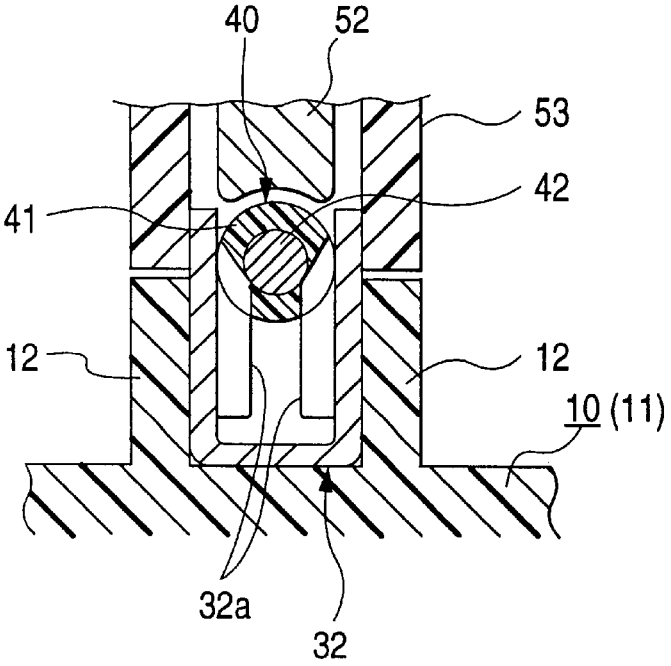
FIG. 8 is a cross-sectional view showing the step of press-connecting the sheathed wire to a crimping portion of the crimping terminal of FIG. 6.

First, the sheathed wire 40 is supplied to a position above the crimping terminal 30 mounted in the wire connecting portion 2 (which is in its open condition) of the housing 1 in its free condition as shown in FIG. 5. In this condition, when the crimping jig 50 is moved downward, the cramper 51 cooperates with a jig receiving member 70 to inwardly bend the upright wire holding portion 33 to thereby clamp the sheathed wire 40 in such a manner that distal ends 33*a* of the wire holding portion 33 pierce the sheath 41 of the sheathed wire 40 to make electrical contact with the conductor 42, as shown in FIG. 7. The press piece portion 52, moving downward together with the cramper 51, presses the sheathed wire 40 into the crimping terminal 30, so that the crimping blades 32*a* cut the sheath 41 to make electrical contact with the conductor 42, as shown in FIG. 8.

As shown in FIG. 7, the jig receiving member 70 has a serrated configuration so that it can be fitted in notched recesses 10*a* formed in that end portion of the wire connecting portion 2 of the housing 10, 11 remote from the terminal connecting portion 3. The showing of the notched recesses 10*a* is omitted from FIG. 5.

Figure 9:
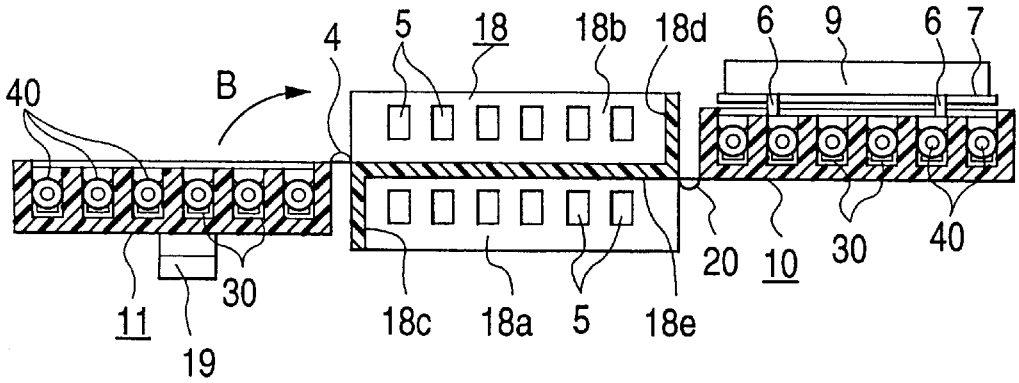
FIGS. 9(*a*)–9(*c*) are a cross-sectional view taken along the line IX—IX of FIG. 5, showing a process of assembling the crimping connector of the above embodiment, FIG. 9(*a*) being a view showing the step of stacking an upper-stage housing, FIG. 9(*b*) being a view showing the step of stacking a lower-stage housing, and FIG. 9(*c*) being a view showing a condition in which the upper-stage and lower-stage housings are stacked together.
Figure 9:
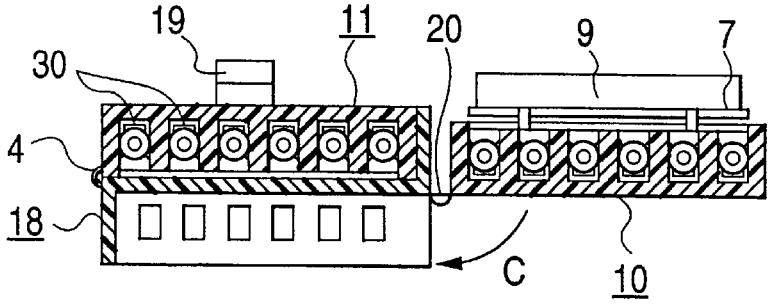
Figure 9:
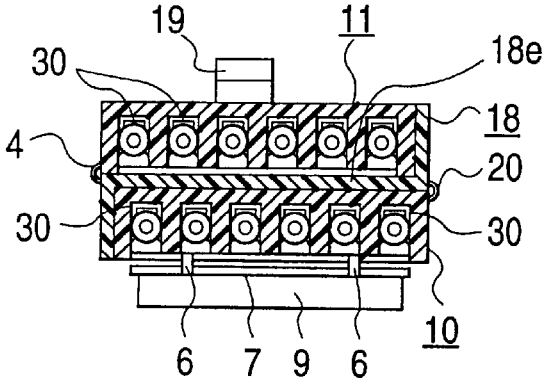

Thus, the sheathed wire 40 is press-connected to each of the crimping terminals 30 mounted on the lower-stage and upper-stage housings 10 and 11. The press-connected condition of the sheathed wire 40 is shown in FIG. 9(*a*). The wire connecting portions 2 of the two housings 10 and 11 are upwardly open, and therefore the process of press-connecting the sheathed wires 40 can be easily effected merely by horizontally moving one of the housing 1 and the crimping jig 50, and thus the whole of the housing 1 does not need to be inverted.

After the sheathed wires 40 are press-connected, the stacking operation is effected as shown in FIG. 9. More specifically, the upper-stage housing 11 is pivotally moved about the first hinges 4 in the direction of arrow B (FIG. 9(*a*)) to be superposed on the upper surface of the flat plate portion 18*e* of the cover member 18. In this stacked condition, the upper surface of the wire connecting portion 2 of the upper-stage housing 11 is closed by the flat plate portion 18*e* of the cover member 18, and the crimping terminals 30 are in an inverted condition with respect to their initially-mounted condition, as shown in FIG. 9(*b*).

Then, the lower-stage housing 10 is pivotally moved about the second hinges 20 in the direction of arrow C (FIG. 9(*b*)) to be held against the lower surface of the flat plate portion 18*e* of the cover member 18. In this stacked condition, the lower surface of the lower-stage housing 10 is held against the lower surface of the flat plate portion 18*e* of the cover member 18, and the crimping terminals 30 are directed downwardly as described above for the upper-stage housing 11, as shown in FIG. 9(*c*).

Then, the sub-cover member 7 is pivotally moved about the third hinges 6 in the direction of arrow D (FIG. 5) to cover the upper surface of the wire connecting portion 2 of the lower-stage housing 10, while maintaining the stacked condition (FIG. 9(*c*)) of the two housings 10 and 11.

Figure 10:
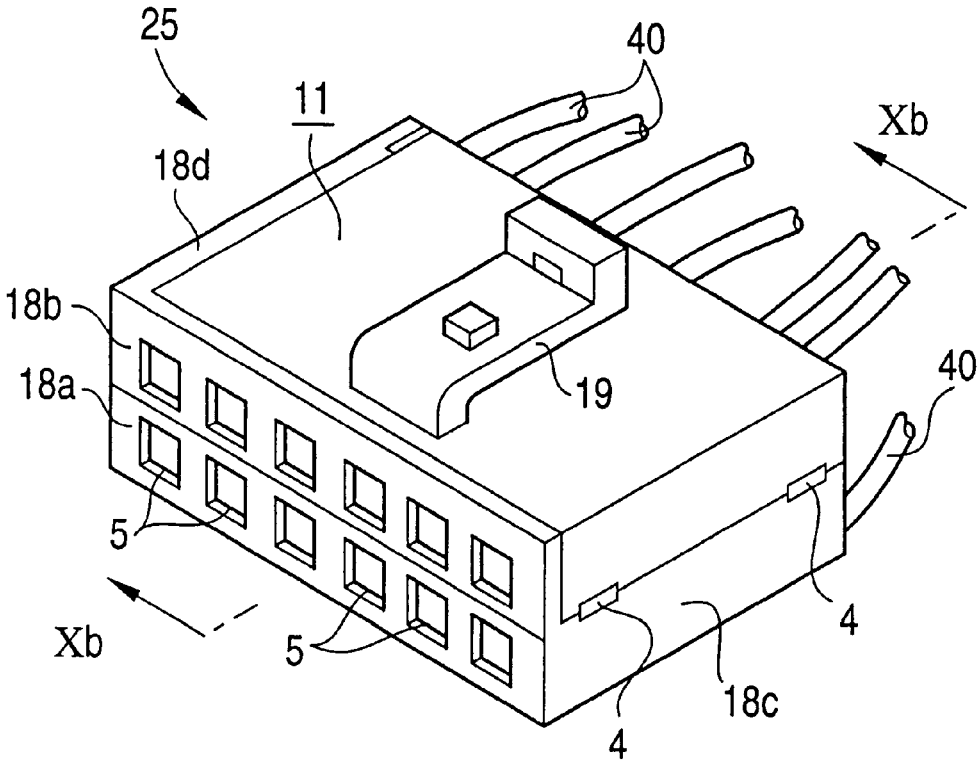
FIG. 10(*a*) is a perspective view of the crimping connector of the above embodiment.
Figure 10:
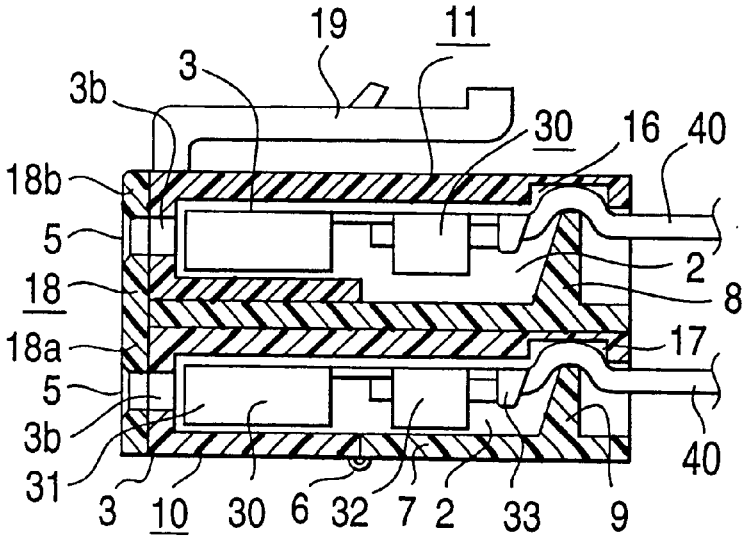

The crimping connector 25 of this embodiment shown in FIG. 10 can be obtained by effecting the above assembling process. In this crimping connector 25, the crimping terminals 30, mounted on the housing 10, and the crimping terminals 30, mounted on the housing 11, are arranged vertically in the same normal direction, and therefore the terminals of the mating connector to be fitted relative to the crimping connector 25 can also be arranged therein in a normal direction, so that the efficiency of arrangement of the terminal assembly in the mating connector is enhanced.

In the crimping connector 25, the housings 10 and 11, the cover member 18 and the sub-cover member 7 are integrally connected together through the first, second and third hinges 4, 20 and 6, and therefore any registration operation for the parts is not necessary at the time of the stacking operation, and this enhances the efficiency of the operation.

In the crimping connector 25, as shown in FIG. 10(*b*), the sheathed wires 40, connected to the wire connecting portion 2 of the upper-stage housing 11, are curved into a generally C-shape, and are held between the projection 8 on the cover member 18 and the recess 16 in the housing 11. Also, the sheathed wires 40, connected to the wire connecting portion 2 of the lower-stage housing 10, are curved into a generally C-shape, and are held between the projection 9 on the sub-cover member 7 and the recess 17 in the housing 10. Therefore the resistance against a pulling force, acting on the sheathed wires 40 connected to the two housings 10 and 11, is increased, thereby enhancing the wire holding force. Therefore, any other press member for the sheathed wires 40 is not necessary, and the stably-connected condition of the sheathed wires 40 can be obtained without increasing the number of the component parts.

In the crimping connector 25, the terminal insertion portions 18*a* and 18*b* for the lower-stage and upper-stage housings 10 and 11 are integrally formed on the cover member 18, and therefore the fitting surfaces (that is, the outer surfaces of the terminal insertion portions 18*a* and 18*b*) for the mating connector can be highly precisely formed without being influenced by warpage of the housings 10 and 11 and a play in the lock portions for locking the housings 10 and 11 to the cover member 18.

Figure 11:
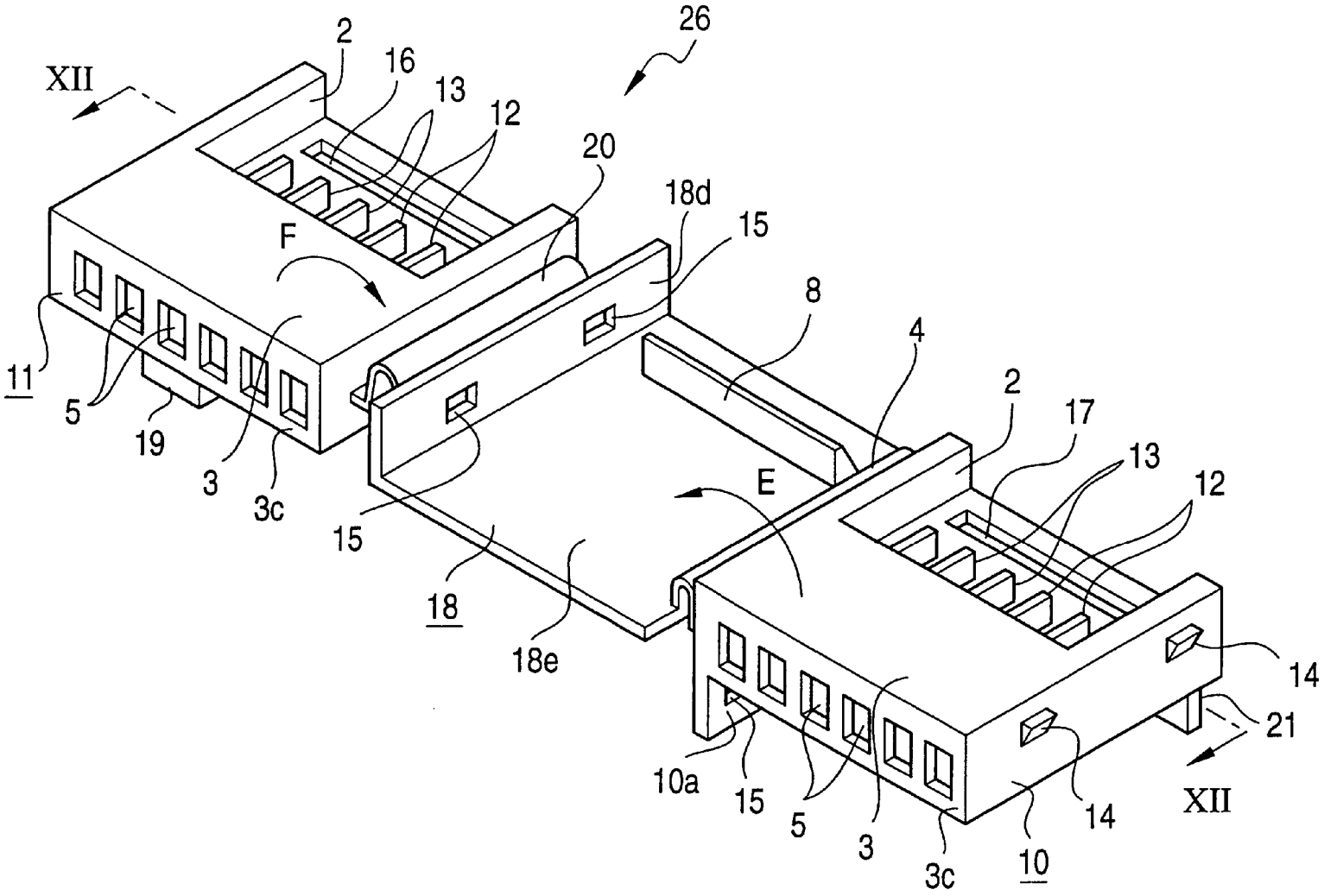
FIG. 11 is a perspective view of a housing used in another embodiment of a crimping connector of the invention.

FIG. 11 shows a housing 26 used in another embodiment of a crimping connector of the invention. This housing 26 differs from the housing 1 only in that lower-stage and upper stage housings 10 and 11 and a cover member 18 are different in configuration from those of the preceding embodiment, and that the direction of pivotal movement of the two housings 10 and 11 for stacking purposes is different. The other construction is the same as that of the housing 1, and therefore identical reference numerals denote corresponding constituent elements, respectively.

Like the above-mentioned housing 1, the housing 26 comprises the lower-stage housing 10 and the upper-stage housing 11 each including an upwardly-open wire connecting portion 2 and a terminal connecting portion 3 of a closed cross-sectional shape communicating with the wire connecting portion 2. The housings 10 and 11 are disposed respectively on opposite sides of the cover member 18, with upper surfaces of the wire connecting portions 2 directed upwardly, and are integrally connected to the cover member 18 through hinges 20 and 4 so that the wire connecting portions 2 of the two housings 10 and 11, as well as the terminal connecting portions 3 thereof, can be stacked together relative to the cover member 18 vertically in the same position and the same direction.

The cover member 18 is in the form of a cross-sectionally L-shaped plate, and has an upper side wall 18*d* formed integrally on one side edge of a flat plate portion 18*e*. Terminal insertion portions 3*c* each having terminal insertion ports 5 are formed integrally at one ends of the terminal connecting portions 3 of the lower-stage and upper-stage housings 10 and 11. The lower-stage housing 10 has a lower side wall 10*a* formed an one side edge thereof, and a projection 21, which is opposed to a recess 16 in the upper-stage housing 11 in the stacked condition, is formed on a lower surface of the lower-stage housing 10. Retaining holes 15 are formed in the upper side wall 18*d* and the lower side wall 10*a*. In FIG. 11, retaining projections 14 are formed on that side surface of the lower-stage housing 10 remote from the lower side wall 10*a*, and in the stacked condition of the lower-stage housing 10, the retaining projections 14 are engaged respectively in the retaining holes 15 in the upper side wall 18*d*, thereby maintaining the stacked condition of the lower-stage housing 10. Similar retaining projections (not shown) are formed on the upper-stage housing 11, and in the stacked condition of the upper-stage housing 11, these retaining projections are engaged respectively in the retaining holes 15 in the lower side wall 10*a*, thereby maintaining the stacked condition of the upper-stage housing 11.

In the housing 26, the upper-stage housing 11 is disposed adjacent to the upper side wall 18*d* of the cover member 18, with its wire connecting portion 2 kept open upwardly, while the lower-stage housing 10 is disposed adjacent to the other side of the cover member 18, with its wire connecting portion 2 kept open upwardly, and the lower-stage and upper-stage housings 10 and 11 and the cover member 18 are connected together at their adjacent portions through the first and second hinges 4 and 20. The housing 26, having such connecting structures, is formed into an integral construction, using an electrically-insulating resin.

Figure 12:
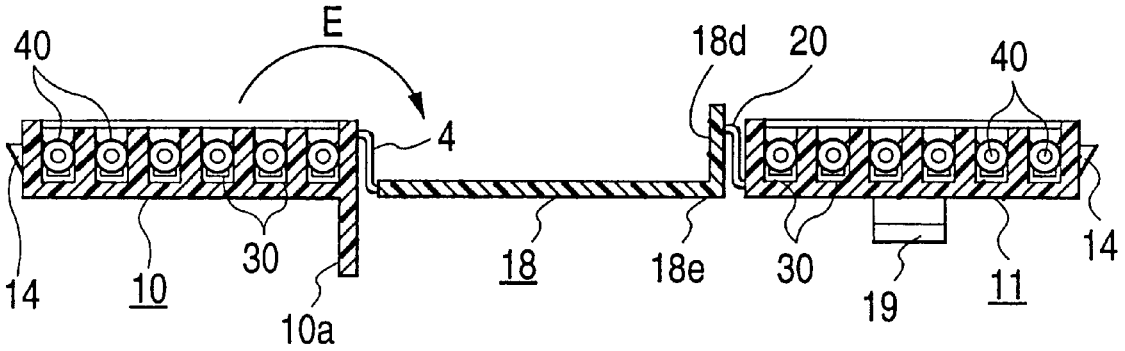
FIGS. 12(*a*)–12(*c*) each is a cross-sectional view taken along the line XII—XII of FIG. 11, showing a process of assembling the crimping connector of the above embodiment, FIG. 12(*a*) being a view showing the step of stacking an upper-stage housing, FIG. 12(*b*) being a view showing the step of stacking a lower-stage housing, and FIG. 12(*c*) being a view showing a condition in which the upper-stage and lower-stage housings are stacked together.
Figure 12:
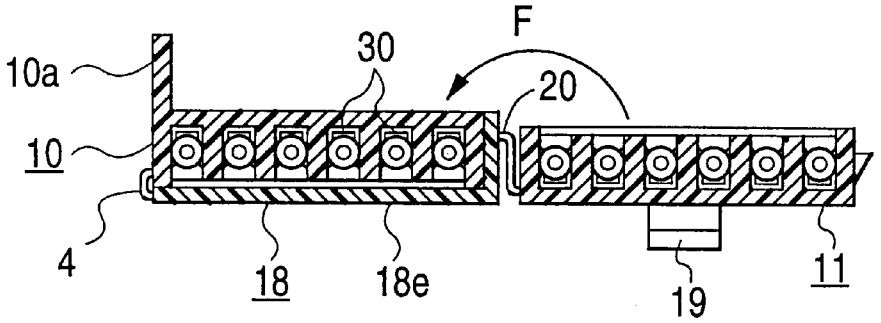
Figure 12:
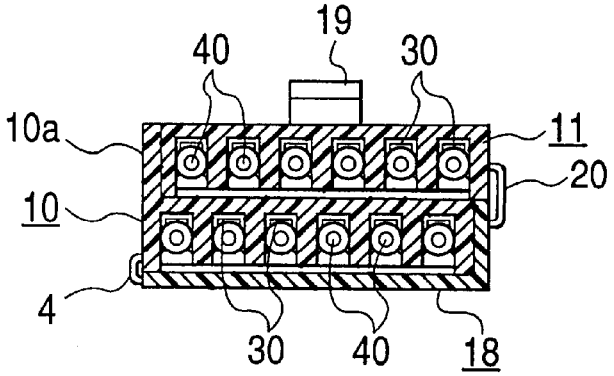

As in the preceding embodiment, crimping terminals 30 are mounted on the lower-stage and upper-stage housings 10 and 11, and sheathed wires 40 are press-connected to these crimping terminals 30, respectively. The press-connected condition of the sheathed wires 40 is shown in FIG. 12(*a*). The wire connecting portions 2 of the two housings 10 and 11 are upwardly open, and therefore the process of press-connecting the sheathed wires 40 can be easily effected without the need for inverting the whole of the housing 26.

After the sheathed wires 40 are press-connected, the stacking operation is effected as shown in FIG. 12. More specifically, the lower-stage housing 10 is pivotally moved about the first hinge 4 in a direction of arrow E (see FIG. 11 and FIG. 12(*a*)) to be superposed on the upper surface of the flat plate portion 18*e* of the cover member 18. In this stacked condition, the upper surface of the wire connecting portion 2 of the lower-stage housing 10 is closed by the flat plate portion 18*e* of the cover member 18, and the crimping terminals 30 are in an inverted condition with respect to their initially-mounted condition, as shown in FIG. 12(*b*).

Then, the upper-stage housing 11 is pivotally moved about the second hinge 20 in a direction of arrow F (see FIG. 11 and FIG. 12(*b*)) to be superposed on the lower surface of the lower-stage housing 10. In this stacked condition, the upper surface of the wire connecting portion 2 of the upper-stage housing 11 is closed by the lower surface of the already-stacked lower-stage housing 10, and the crimping terminals 30 are directed downwardly as described above for the lower-stage housing 10.

Figure 13:
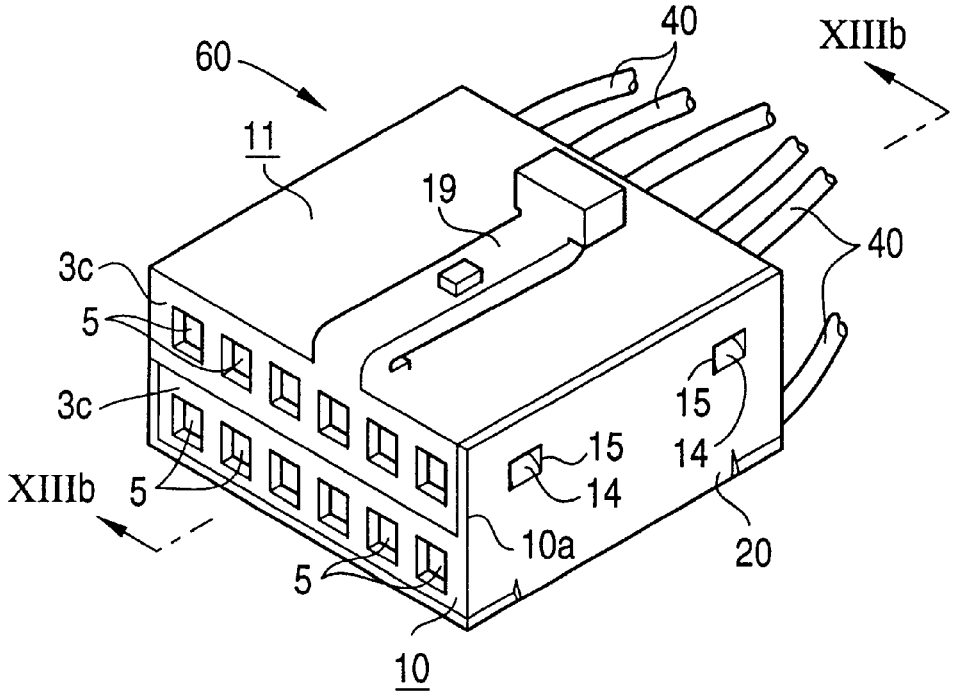
FIG. 13(*a*) is a perspective view of the crimping connector of the above embodiment.
Figure 13:
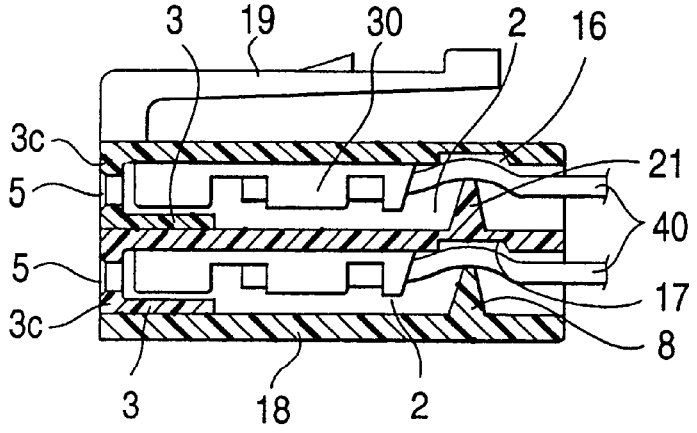

The crimping connector 60 of this embodiment shown in FIG. 13 can be obtained by effecting the above assembling process. In this crimping connector 60, there is no need to provide a sub-cover member for covering the upper surface of the wire connecting portion 2 of one of the two housings 10 and 11, and therefore the molding can be effected more easily, and also the time and labor required for the operation is reduced, so that the efficiency of the operation is enhanced.

In this crimping connector 60 as in the crimping terminal 25, a terminal assembly in the mating connector can be arranged more easily since the crimping terminals in the lower-stage and upper-stage housings 10 and 11 are arranged in the normal direction, and besides any registration operation for the lower-stage and upper-stage housings 10 and 11 and the cover member 18, connected together through the first and second hinges 4 and 20, is not necessary at the time of the stacking operation, so that the efficiency of the operation is enhanced.

In the crimping connector 60, as shown in FIG. 13(*b*), the sheathed wires 40, connected to the lower-stage housing 10, are curved into a generally C-shape, and are held between a projection 8 on the cover member 18 and a recess 17 in the lower-stage housing 10. Also, the sheathed wires 40, connected to the upper-stage housing 11, are curved into a generally C-shape, and are held between the projection 21 on the lower-stage housing 10 and the recess 16 in the upper-stage housing 11. Therefore the wire holding force is enhanced as described above for the crimping connector 25.

The present invention is not limited to the above embodiments, and various modifications can be made within the scope of the invention.

For example, the recesses 17 and 16, formed in the two housings 10 and 11 of the crimping connectors 25 and 26, may be replaced respectively by slits formed vertically through the respective housings.

As described above in detail, the following advantageous effects can be achieved by the present invention:

In the first aspect of the present invention, the two housings and the cover member are integrally connected together through the hinges, and therefore any operation for registering each housing with the cover member or for registering the housings with each other is not necessary, and the efficiency of the assembling operation is enhanced. And besides, when the two housings are stacked together, the crimping terminals, mounted on the upper-stage housing, and the crimping terminals, mounted on the lower-stage housing, are arranged vertically in the same position and the same direction, and also the terminals in the mating connector can be arranged in the normal direction, so that the efficiency of arrangement of the terminals in the mating connector is enhanced.

In the second aspect of the present invention, the sub-cover member for covering the wire connecting portion of the other housing is integrally connected to this housing through the hinge, and therefore the number of the component parts is not increased, and any operation for registering the sub-cover member with the housing is not necessary at the time of the stacking operation, so that the efficiency of the operation is enhanced.

In the third aspect of the present invention, any sub-cover member for covering the wire connecting portion of the other housing is not necessary, and therefore the number of the stacking operations is reduced, so that the efficiency of the operation is further enhanced.

In the fourth aspect of the present invention, the terminal insertion portions for the two housings are formed integrally with the cover member, and therefore the fitting surfaces for the mating connector can be highly precisely formed without being influenced by warpage of the housings and a play in the lock portions.

In the fifth aspect of the present invention, the sheathed wires, connected to the wire connecting portion of each of the housings, are held between the recess in the housing and the projection on the cover member or the sub-cover member, so that the force of holding of the sheathed wires is enhanced, and therefore the stably-connected condition of the sheathed wires can be obtained without increasing the number of the component parts.

In the sixth aspect of the present invention, the sheathed wires, connected to the wire connecting portion of each of the housings, are held between the recess in the housing and the projection on one housing or the cover member, so that the force of holding of the sheathed wires is enhanced, and therefore the stably-connected condition of the sheathed wires can be obtained without increasing the number of the component parts.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A crimping connector comprising:

two housings each including an upwardly-open wire connecting portion and a terminal connecting portion of a closed cross-sectional shape communicating with said wire connecting portion;

a cover member having opposite sides on which said two housings are disposed respectively while upper surfaces of said wire connecting portions both of said two housings are directed upwardly; and hinge members integrally connecting each of said two housings to said cover member in such a manner that said wire connecting portions of said two housings, as well as said terminal connecting portions of said two housings, can be stacked together relative to said cover member vertically in the same position and the same direction.

2. A crimping connector according to claim 1, in which said cover member is integrally provided with terminal insertion portions for said two housings through which terminals of a mating connector can pass.

3. A crimping connector according to claim 1, in which said hinge members comprises a first hinge and a second hinge, wherein one of said two housings is connected to said cover member through said first hinge so that said one housing can be turned to be superposed on said cover member while the upper surface of said wire connecting portion thereof is opposed to an upper surface of said cover member, and the other housing is connected to said cover member through said second hinge so that said other housing can be turned to underlie said cover member while a lower surface of said wire connecting portion thereof is opposed to a lower surface of said cover member.

4. A crimping connector according to claim 3, in which said cover member is integrally provided with terminal insertion portions for said two housings through which terminals of a mating connector can pass.

5. A crimping connector according to claim 3, further comprising:

a sub-cover member for covering the upper surface of said wire connecting portion of said other housing, in which said hinge members further comprises a third hinge through which said sub-cover member is connected to said terminal connecting portion of said other housing.

6. A crimping connector according to claim 5, in which said cover member is integrally provided with terminal insertion portions for said two housings through which terminals of a mating connector can pass.

7. A crimping connector according to claim 5, further comprising:

recess portion formed on a bottom surface of said wire connecting portion of each of said two housings, disposed adjacent to a side edge portion remote from said terminal connecting portion, and extended along said side edge portion;

projections respectively formed on said cover member and said sub-cover member in such a manner that said projections are opposed respectively to said recess portions in the stacked condition in which said two housings are stacked on said cover member and the upper surface of said wire connecting portion of said other housing is covered by said sub-cover member.

8. A crimping connector according to claim 1, in which said hinge members comprises a first hinge and a second hinge, wherein one of said two housings is connected to said cover member through said first hinge so that said one housing can be turned to be superposed on said cover member while the upper surface of said wire connecting portion thereof is opposed to an upper surface of said cover member, and the other housing is connected to said cover member through said second hinge so that said other housing can be turned to be superposed on said one housing in the stacked condition while the upper surface of said wire connecting portion thereof is opposed to said one housing.

9. A crimping connector according to claim 8, in which said cover member is integrally provided with terminal insertion portions for said two housings through which terminals of a mating connector can pass.

10. A crimping connector according to claim 8, further comprising:

recess portion formed on a bottom surface of said wire connecting portion of each of said two housings, disposed adjacent to a side edge portion remote from said terminal connecting portion, and extended along said side edge portion;

projections are formed respectively on said cover member and said one housing in such a manner that said projections are opposed respectively to said recesses in the stacked condition of said two housings.

* * * * *